US010749299B2

(12) United States Patent
Tada

(10) Patent No.: US 10,749,299 B2
(45) Date of Patent: Aug. 18, 2020

(54) CONNECTOR

(71) Applicant: Japan Aviation Electronics Industry, Limited, Tokyo (JP)

(72) Inventor: Takashi Tada, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 16/400,327

(22) Filed: May 1, 2019

(65) Prior Publication Data

US 2020/0091659 A1 Mar. 19, 2020

(30) Foreign Application Priority Data

Sep. 18, 2018 (JP) ..... 2018-173860

(51) Int. Cl.

| | |
|---|---|
| ***H01R 13/6471*** | (2011.01) |
| ***H01R 13/6467*** | (2011.01) |
| ***H01R 12/72*** | (2011.01) |
| ***H01R 13/6582*** | (2011.01) |
| ***H01R 13/502*** | (2006.01) |
| ***H01R 43/16*** | (2006.01) |
| ***H01R 12/57*** | (2011.01) |
| *H01R 107/00* | (2006.01) |

(52) U.S. Cl.

CPC ..... *H01R 13/6471* (2013.01); *H01R 12/57* (2013.01); *H01R 12/724* (2013.01); *H01R 12/727* (2013.01); *H01R 13/502* (2013.01); *H01R 13/6467* (2013.01); *H01R 13/6582* (2013.01); *H01R 43/16* (2013.01); *H01R 2107/00* (2013.01)

(58) Field of Classification Search

CPC ..... H01R 13/6471; H01R 13/6467; H01R 13/6582; H01R 13/502; H01R 12/57; H01R 12/724; H01R 12/727; H01R 43/16; H01R 2107/00

See application file for complete search history.

(56) References Cited

U.S. PATENT DOCUMENTS

| | | | | |
|---|---|---|---|---|
| 9,142,920 | B2 * | 9/2015 | Oyake | H01R 13/6461 |
| 9,847,595 | B2 * | 12/2017 | Tsai | H01R 13/521 |
| 9,935,393 | B2 * | 4/2018 | Tada | H01R 12/724 |
| 9,948,022 | B2 * | 4/2018 | Arai | H01R 13/6587 |
| 10,116,107 | B2 * | 10/2018 | Tada | H01R 4/02 |
| 10,340,629 | B2 * | 7/2019 | Tada | H01R 13/521 |
| 2014/0106630 | A1 | 4/2014 | Oyake | |
| 2017/0187140 | A1 * | 6/2017 | Tsai | H01R 13/521 |

FOREIGN PATENT DOCUMENTS

JP 5970329 B2 8/2016

* cited by examiner

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A connector includes a plurality of contacts having a first pair of contacts and a second pair of contacts, and a housing configured to hold the plurality of contacts, the plurality of contacts each including a contact portion to be in contact with a contact of a mating connector, a connection portion to be connected to a connection target object, and a held portion disposed between the contact portion and the connection portion and embedded in the housing, the first pair of contacts each including, in the held portion, a deformed portion partially separated from the second pair of contacts.

18 Claims, 9 Drawing Sheets

CONNECTOR

BACKGROUND OF THE INVENTION

The present invention relates to a connector, particularly to a connector including pairs of contacts for high-speed signal transmission and pairs of contacts for low-speed signal transmission.

As a data transmission scheme, a differential transmission scheme is known in which opposite-phase signals are output to a pair of signal lines and data is transmitted by a potential difference between the signal lines. The differential transmission scheme, which has advantages such as high speed and stability, strong noise resistance, and low power consumption, is employed in various data transmission fields.

A connector suited to such a differential transmission scheme is disclosed in JP 5970329 B, for example. The connector, as shown in FIG. 23, includes a housing 1 made of an insulating material, a plurality of contacts 2 that are conductive and held by the housing 1, and a metal shell 3 that covers the outer peripheral portion of the housing 1.

FIG. 24 shows a configuration of the plurality of contacts 2. A ground contact G to be connected to the ground and a pair of signal contacts S for transmitting differential signals are alternately arranged. The ground contact G and the signal contact S each include a contact portion 4 disposed on one end side and to be in contact with a contact of a mating connector (not shown) and a mount portion 5 disposed on the other end side and to be mounted on a circuit substrate (not shown), and a fixation portion 6 disposed between the contact portion 4 and the mount portion 5 and to be embedded and fixed in the housing 1.

Each of the ground contact G has a bent portion 7 bent to protrude inward at the fixation portion 6. Due to the existence of the bent portion 7, the ground contact G is partially separated from an adjacent pair of signal contacts S, so that the alignment pitches of the plurality of contacts 2 are narrowed while maintaining desired transmission characteristics to achieve miniaturization of the connector.

However, for example, like so-called Universal Serial Bus (USB) Type-C connector, there is an issue in a connector including pairs of contacts for high-speed signal transmission complying with the USB 3.1 standard as well as pairs of contacts for low-speed signal transmission at relatively low-speed complying with the USB 2.0 standard that, even if the ground contact G including the bent portion 7 is disposed between these pairs of contacts as in JP 5970329 B, a noise generated at the pairs of contacts for low-speed signal transmission has an effect on the pairs of contacts for high-speed signal transmission, whereby crosstalk occurs to deteriorate the transmission characteristics.

SUMMARY OF THE INVENTION

The invention is made to solve the above-described issue of the related art, and aims to provide a connector, even though including pairs of contacts for high-speed signal transmission and pairs of contacts for low-speed signal transmission, enabling reducing the influence of the crosstalk.

A connector according to the invention includes a plurality of contacts each extending in a fitting direction, the plurality of contacts including a first pair of contacts and a second pair of contacts and being aligned in an alignment direction orthogonal to the fitting direction, and a housing configured to hold the plurality of contacts, wherein the plurality of contacts each include a contact portion disposed at a front end in the fitting direction and to be in contact with a contact of a mating connector, a connection portion disposed at a back end in the fitting direction and to be connected to a connection target object, and a held portion disposed between the contact portion and the connection portion and embedded in the housing, and wherein the first pair of contacts each include, in the held portion, a deformed portion partially separated from the second pair of contacts.

DETAILED DESCRIPTION OF INVENTION

Embodiments of the invention will be described below with reference to the accompanying drawings.

Figure 1:
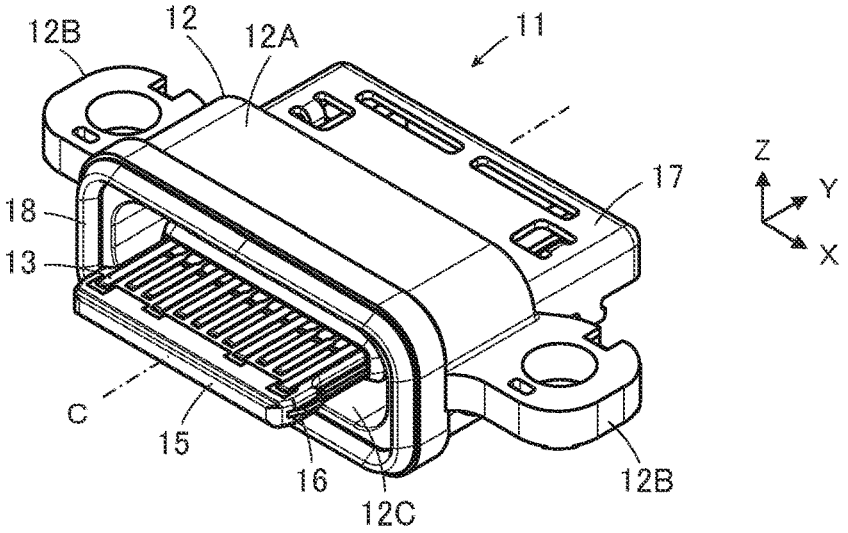
FIG. 1 is a perspective view of a connector according to an embodiment of the invention as viewed obliquely from above.
Figure 2:
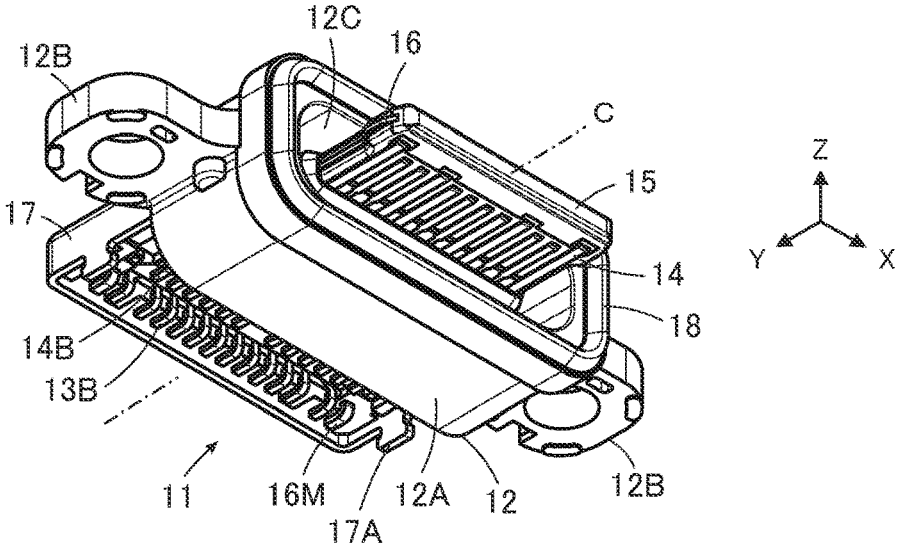
FIG. 2 is a perspective view of the connector according to the embodiment as viewed obliquely from below.
Figure 3:
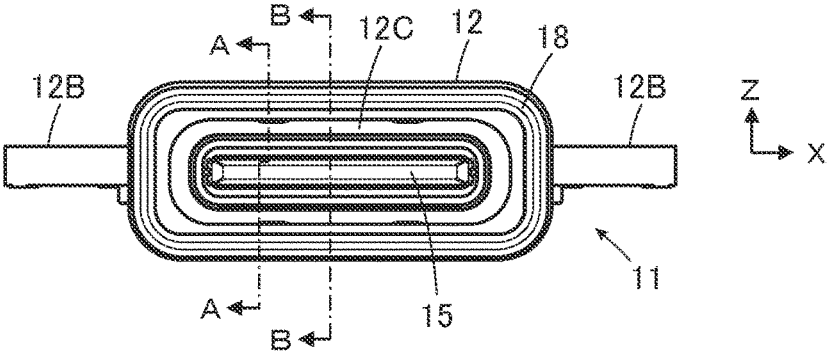
FIG. 3 is a front view of the connector according to the embodiment.

FIGS. 1 to 3 show a connector 11 according to an embodiment. The connector 11 is a receptacle connector to be fixed on a substrate in an electronic device such as a portable device or an information device and to be fitted to a mating connector (not shown) along a fitting axis C.

The connector 11 includes a housing 12, a plurality of first contacts 13 each extending in the direction of the fitting axis C and being aligned in a direction orthogonal to the fitting axis C, and a plurality of second contacts 14 each extending in the direction of the fitting axis C and being aligned in parallel with the plurality of first contacts 13. The plurality of first contacts 13 and the plurality of second contacts 14 are each made of a conductive material such as metal, and are held by the housing 12.

The housing 12 is made of an insulating resin and includes a tubular portion 12A in a flat tubular shape extending along the fitting axis C to cover around the plurality of first contacts 13 and the plurality of second contacts 14, and a pair of fixation portions 12B protruding from both side portions of the tubular portion 12A.

A mating connector receiving portion 12C into which a mating connector (not shown) is to be inserted is formed inside the tubular portion 12A. A tongue portion 15 being a part of the housing 12 is disposed in the mating connector receiving portion 12C. The tongue portion 15 is configured to hold front end portions of the plurality of first contacts 13 in the direction of the fitting axis C and front end portions of the plurality of second contacts 14 in the direction of the fitting axis C, and a mid-plate 16 made of metal is disposed, being embedded in the tongue portion 15, between the plurality of first contacts 13 and the plurality of second contacts 14.

For ease of understanding, the direction from the front portion to the back portion of the connector 11 along the fitting axis C is referred to as a +Y direction, the alignment direction of the plurality of first contacts 13 and the plurality of second contacts 14 is referred to as a X direction, and the direction perpendicular to the XY plane and directed from the second contact 14 side to the first contact 13 side is referred to as a +Z direction.

A metal shell 17 that covers the end portions in the +Y direction of the plurality of first contacts 13 and the plurality of second contacts 14 is disposed on the +Y direction side of the tubular portion 12A.

On the end portion in the −Y direction of the tubular portion 12A, there is disposed a seamless waterproof member 18 that surrounds the end portion in the −Y direction of the mating connector receiving portion 12C and is made of an elastic material such as rubber.

The tongue portion 15 protrudes toward the −Y direction side relative to the tubular portion 12A. The plurality of first contacts 13 are aligned on the surface of the tongue portion 15 on the +Z direction side, while the plurality of second contacts 14 are aligned on the surface of the tongue portion 15 on the −Z direction side.

Figure 4:
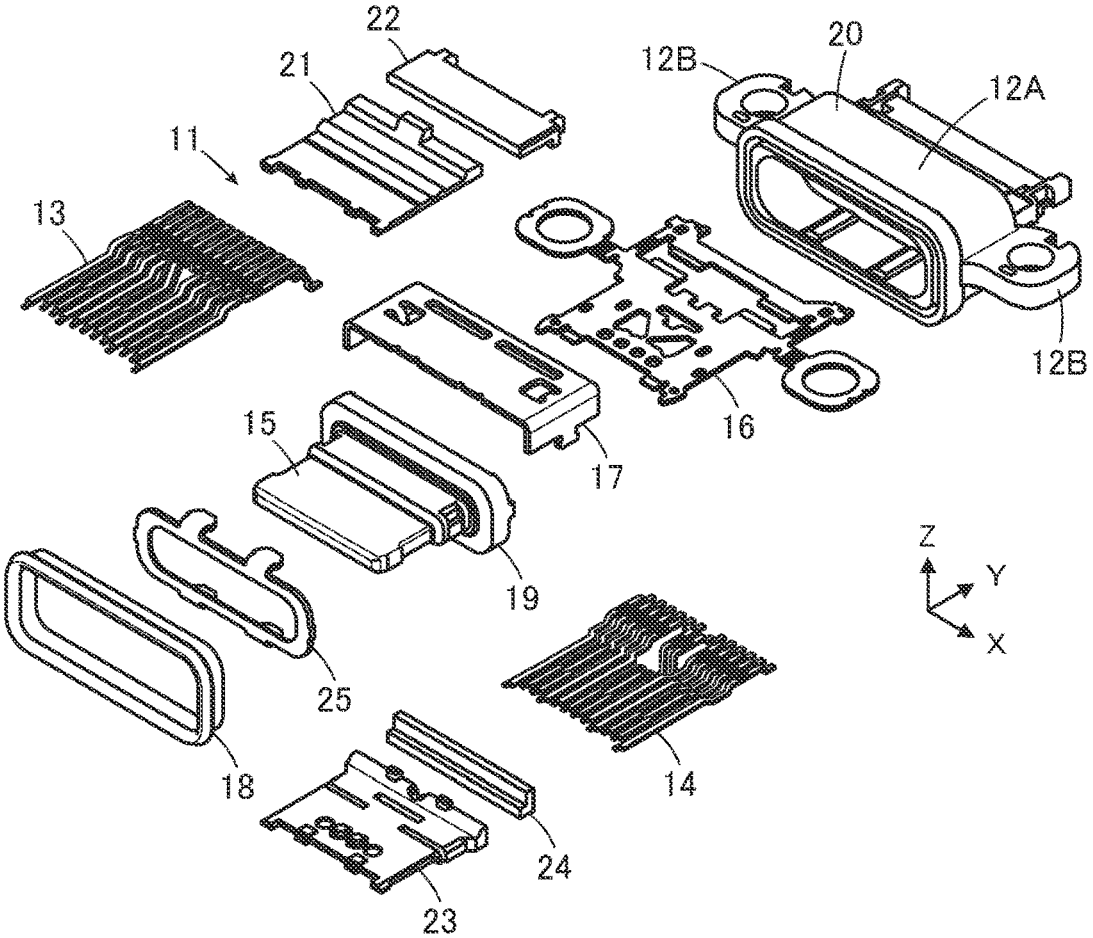
FIG. 4 is an exploded view of the connector according to the embodiment.

An exploded view of the connector 11 is shown in FIG. 4. The connector 11 includes the plurality of first contacts 13, the plurality of second contacts 14, the mid-plate 16, a first insulator 19 that forms the tongue portion 15 of the housing 12, a second insulator 20 that forms the tubular portion 12A and the pair of fixation portion 12B of the housing 12, the metal shell 17, and the waterproof member 18.

The connector 11 further includes insulators 21 and 22 for modularizing the plurality of first contacts 13, insulators 23 and 24 for modularizing the plurality of second contacts 14, and an inner plate 25 fitted into the first insulator 19.

The housing 12 is composed with the first insulator 19, the second insulator 20, and the insulators 21 to 24.

Figure 5:
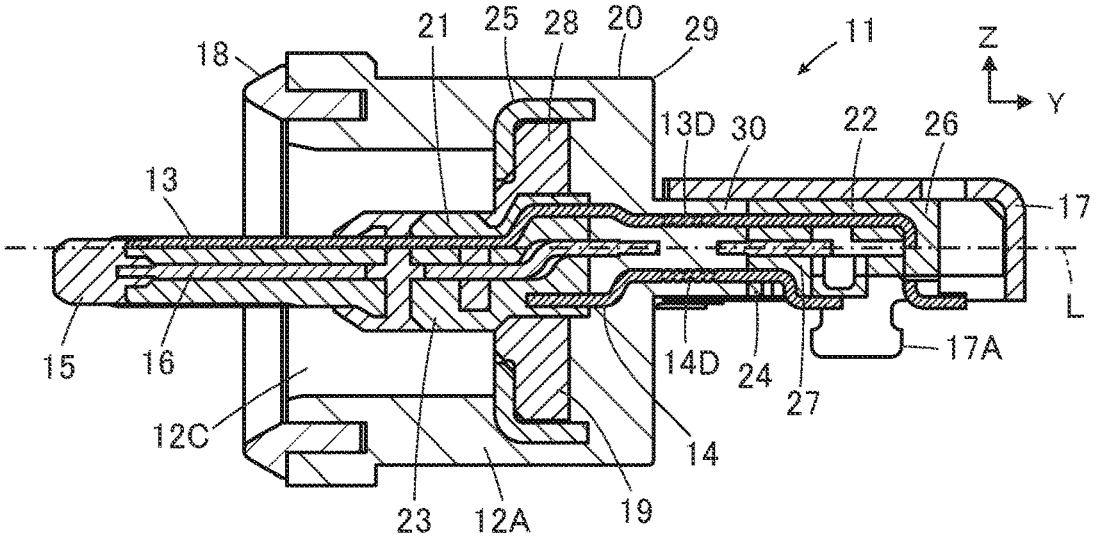
FIG. 5 is a cross-sectional view taken along the line A-A of FIG. 3.

A side cross-sectional view of the connector 11 is shown in FIG. 5. Note that, in FIG. 5, the portion on the +Z direction side relative to a dashed line L extending in the Y direction indicates a cross section of the connector 11 cut along the YZ plane passing through the first contact 13, while the portion of the connector 11 on the −Z direction side relative to the dashed line L indicates a cross section of the connector 11 cut along the YZ plane passing through the second contact 14.

The first insulator 19 is molded in a state where the mid-plate 16 is clamped between a first module 26 in which the plurality of first contacts 13 are modularized by the insulators 21 and 22, and a second module 27 in which the plurality of second contacts 14 are modularized by the insulators 23 and 24. The first insulator 19 includes the tongue portion 15 and a flange portion 28 extending along the XZ plane at the end portion in the +Y direction of the tongue portion 15.

The inner plate 25 is fitted into the flange portion 28 of the first insulator 19. The inner plate 25, which is to be abutted against a mating connector (not shown) to be inserted into the mating connector receiving portion when fitting is performed, is made of metal or resin and is disposed on the face of the flange portion 28, on the −Y direction side, facing the mating connector receiving portion 12C.

The second insulator 20 is molded to cover the flange portion 28 of the first insulator 19 and the inner plate 25. The second insulator 20 includes the tubular portion 12A, a bottom plate portion 29 that closes the end portion in the +Y direction of the tubular portion 12A, and a flat plate portion 30 protruding from the bottom plate portion 29 toward the +Y direction side and extending along the XY plane.

The plurality of first contacts 13 and the plurality of second contacts 14, and the mid-plate 16 pass through the bottom plate portion 29 and the flat plate portion 30 of the second insulator 20 in the Y direction.

On the +Y direction side of the second insulator 20, the metal shell 17 is disposed to cover the end portions in +Y direction of the first module 26 and the second module 27, where leg portions 17A of the metal shell 17 protrude in the −Z direction.

Figure 6:
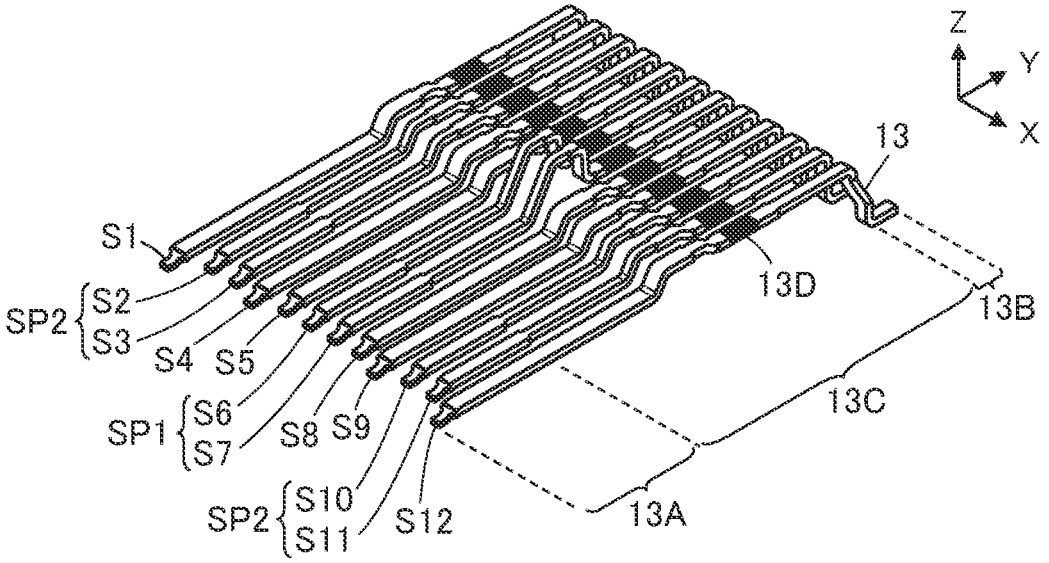
FIG. 6 is a perspective view showing a plurality of first contacts used for the connector according to the embodiment.

As shown in FIG. 6, the first contact 13 is composed of a plate-like member extending in the Y direction, where at an end portion in the −Y direction of the first contact 13, namely the front end in the fitting direction, a contact portion 13A to be in contact with the contact of the mating connector (not shown) is disposed, and a connection portion 13B to be connected to a connection target object such as a substrate is disposed at an end portion in the +Y direction of the first contact 13, namely the back end in the fitting direction. Between the contact portion 13A and the connection portion 13B, a held portion 13C is disposed, which is embedded in the housing 12 to be held by the housing 12.

On the predetermined location of the held portion 13C, a contact-side waterproof shaped portion 13D is formed. The contact-side waterproof shaped portion 13D is embedded in the second insulator 20 to block entry of water along the interface with the second insulator 20, and includes at least one groove or projection formed on the surface of the first contact 13 to surround and enclose the first contact 13.

The plurality of first contacts 13 include twelve contacts S1 to S12 each extending in the Y direction and being aligned from the −X direction to the +X direction. Among these contacts, two contacts S6 and S7 located at the center portion in the X direction constitute a first pair SP1 of contacts for low-speed signal transmission, the contacts S1 and S12 located at the outermost sides in the X direction serve as ground contacts, and two contacts S2 and S3 adjacent to the contact S1 and two contacts S11 and S10 adjacent to the contact S12 respectively constitute second pairs SP2 of contacts for high-speed signal transmission. The remaining contacts S4, S5, S8, and S9 serve as contacts used for power supply, or contacts used for detecting insertion and extraction of the connector 11 and the like.

The contact portions 13A of the twelve contacts S1 to S12 are mutually located on the same XY plane. The connection portions 13B of the twelve contacts S1 to S12 are mutually located on the same XY plane as well. Further, the contact-side waterproof shaped portions 13D of the twelve contacts S1 to S12 are mutually located at the same position in the Y direction.

Figure 7:
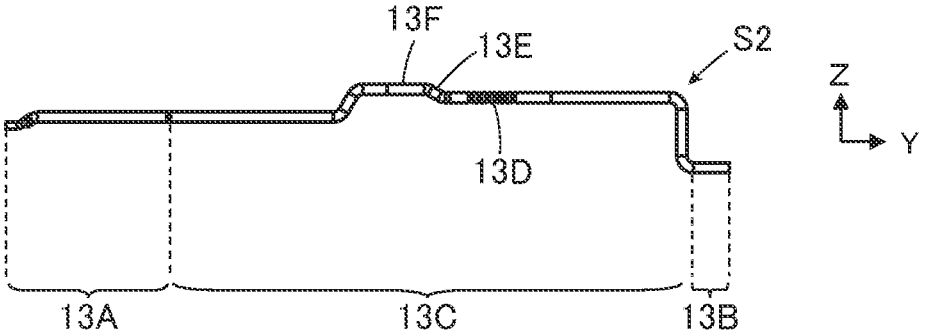
FIG. 7 is a side view showing a first contact for high-speed signal transmission.

FIG. 7 shows a side view of the contact S2 for high-speed signal transmission included in one second pair SP2. The held portion 13C of the contact S2 has a flat portion 13F extending in the Y direction via the step 13E on the −Y direction side of the contact-side waterproof shaped portion 13D and being located on the +Z direction side relative to the contact-side waterproof shaped portion 13D. Another contact S3 for high-speed signal transmission included in the second pair SP2 and the two contacts S10 and S11 for high-speed signal transmission included in the other second pair SP2 have the same shape as the contact S2 shown in FIG. 7.

In addition, the contacts S1, S4, S5, S8, S9, and S12 that are not for signal transmission also have the same shape as the contact S2 for high-speed signal transmission.

Figure 8:
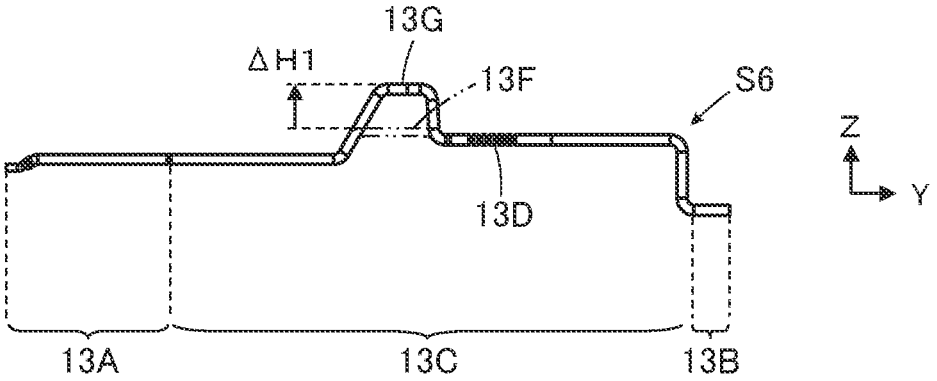
FIG. 8 is a side view showing a first contact for low-speed signal transmission.

FIG. 8 shows a side view of the contact S6 for low-speed signal transmission included in the first pair SP1. The held portion 13C of the contact S6 has, on the −Y direction side of the contact-side waterproof shaped portion 13D, a deformed portion 13G bent toward the +Z direction orthogonal to both the Y direction that is the fitting direction of the connector 11, and the X direction that is the alignment direction of the plurality of first contacts 13. The deformed portion 13G is located at the same position in the Y direction as the flat portion 13F of the contact S2 shown in FIG. 7, and is formed higher than the flat portion 13F of the contact S2 by the height difference ΔH1 in the +Z direction.

Another contact S7 for low-speed signal transmission included in the first pair SP1 has the same shape as the contact S6 shown in FIG. 8, where a deformed portion 13G is formed at the held portion 13C.

The deformed portions 13G of the contacts S6 and S7 for low-speed signal transmission are for partial separation from the contacts S2, S3, S10, and S11 for high-speed signal transmission.

Figure 9:
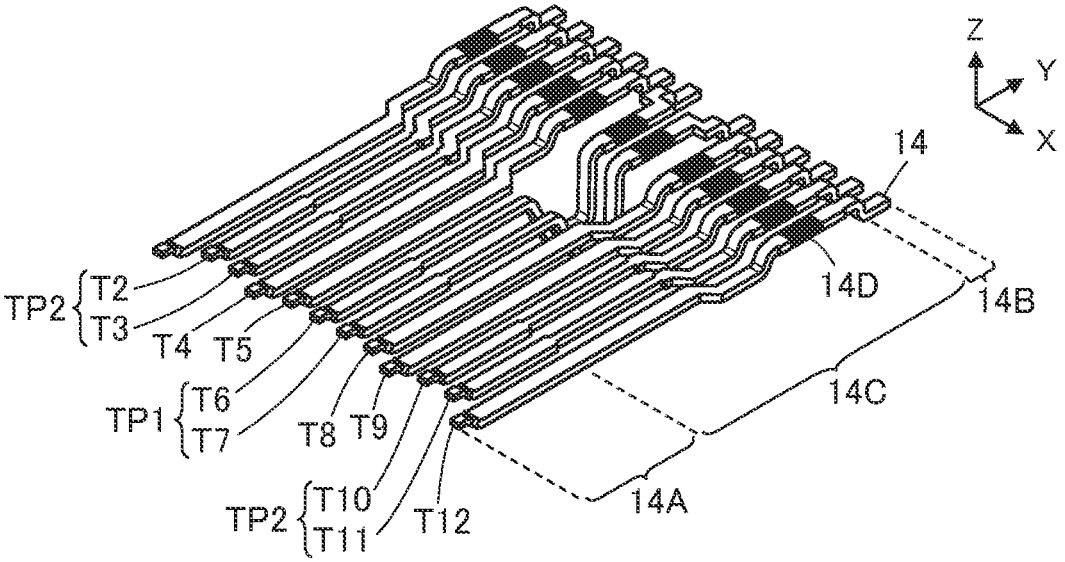
FIG. 9 is a perspective view showing a plurality of second contacts used for the connector according to the embodiment.

Similarly, as shown in FIG. 9, the second contact 14 is composed of a plate-like member extending in the Y direction, where at an end portion in the −Y direction of the second contact 14, namely the front end in the fitting direction, a contact portion 14A to be in contact with the contact of the mating connector (not shown) is disposed, and a connection portion 14B to be connected to a connection target object such as a substrate is disposed at an end portion in the +Y direction of the second contact 14, namely the back end in the fitting direction. Between the contact portion 14A and the connection portion 14B, a held portion 14C is disposed, which is embedded in the housing 12 to be held by the housing 12.

On the predetermined location of the held portion 14C, a contact-side waterproof shaped portion 14D is formed. The contact-side waterproof shaped portion 14D is embedded in the second insulator 20 to block entry of water along the interface with the second insulator 20, and includes at least one groove or projection formed on the surface of the second contact 14 to surround and enclose the second contact 14.

The plurality of second contacts 14 include twelve contacts T1 to T12 each extending in the Y direction and being aligned from the −X direction to the +X direction. Among these contacts, two contacts T6 and T7 located at the center portion in the X direction constitute a first pair TP1 of contacts for low-speed signal transmission, the contacts T1 and T12 located at the outermost side in the X direction serve as ground contacts, and two contacts T2 and T3 adjacent to the contact T1 and two contacts T11 and T10 adjacent to the contact T12 respectively constitute second pairs TP2 of contacts for high-speed signal transmission. The remaining contacts T4, T5, T8, and T9 serve as contacts used for power supply, or contacts used for detecting insertion and extraction of the connector 11 and the like.

The contact portions 14A of the twelve contacts T1 to T12 are mutually located on the same XY plane. The connection portions 14B of the twelve contacts T1 to T12 are mutually located on the same XY plane as well. Further, the contact-side waterproof shaped portions 14D of the twelve contacts T1 to T12 are mutually located at the same position in the Y direction.

Figure 10:
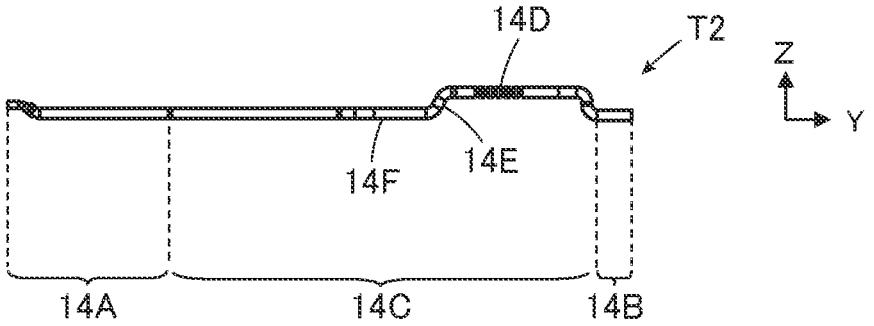
FIG. 10 is a side view showing a second contact for high-speed signal transmission.

FIG. 10 shows a side view of the contact T2 for high-speed signal transmission included in one second pair TP2. The held portion 14C of the contact T2 has a flat portion 14F extending in the Y direction via a step 14E on the −Y direction side of the contact-side waterproof shaped portion 14D and being located on the −Z direction side relative to the contact-side waterproof shaped portion 14D. Another contact T3 for high-speed signal transmission included in the second pair SP2 and two contacts T10 and T11 for high-speed signal transmission included in the other second pair TP2 have the same shape as the contacts T2 shown in FIG. 10.

In addition, the contacts T1, T4, T5, T8, T9, and T12 that are not for signal transmission also have the same shape as the contact T2 for high-speed signal transmission.

Figure 11:
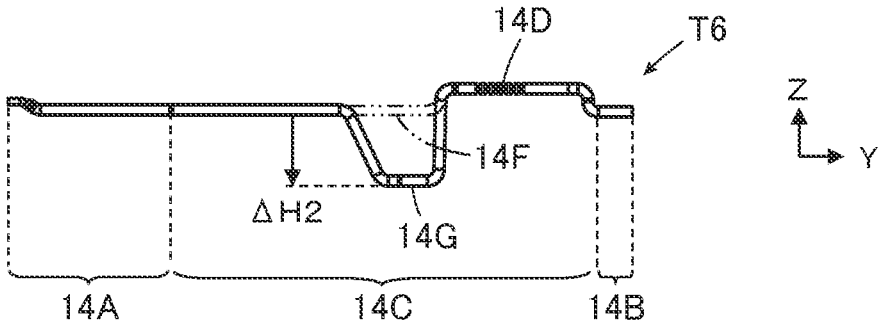
FIG. 11 is a side view showing a second contact for low-speed signal transmission.

FIG. 11 shows a side view of the contact T6 for low-speed signal transmission included in the first pair TP1. The held portion 14C of the contact T6 has, on the −Y direction side of the contact-side waterproof shaped portion 14D, a deformed portion 14G bent toward the −Z direction orthogonal to both the Y direction that is the fitting direction of the connector 11, and the X direction that is the alignment direction of the plurality of second contacts 14. The deformed portion 14G is located at the same position in the Y direction as the flat portion 14F of the contact T2 shown in FIG. 10, and is formed lower than the flat portion 14F of the contact T2 by the height difference ΔH2 in the −Z direction.

Another contact T7 for low-speed signal transmission included in the first pair TP1 has the same shape as the contact T6 shown in FIG. 11, where the deformed portion 14G is formed at the held portion 14C.

The deformed portions 14G of the contacts T6 and T7 for low-speed signal transmission are for partial separation from the contacts T2, T3, T10, and T11 for high-speed signal transmission.

Note that FIG. 5 above shows a cross section of the connector 11 cut along the YZ plane passing through the contact S2 for high-speed signal transmission and the YZ plane passing through the contact T2 for high-speed signal transmission.

Next, a method of manufacturing a connector 11 according to an embodiment will be described.

Figure 12:
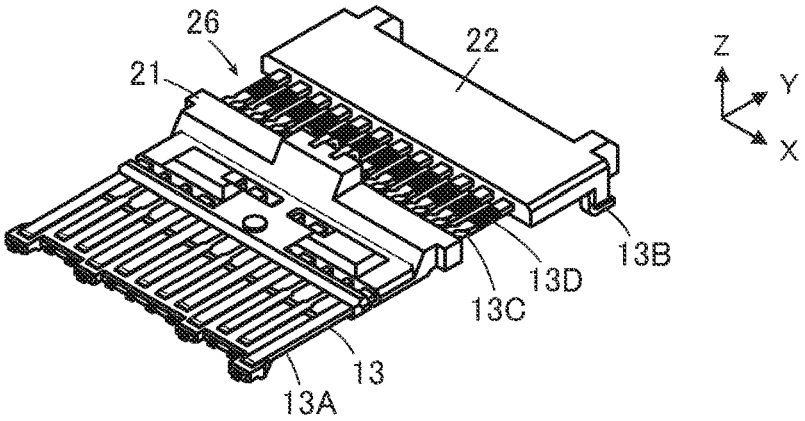
FIG. 12 is a perspective view showing a first module including the plurality of first contacts.

First, as shown in FIG. 12, an insulator 21 surrounding the front portions of the held portions 13C of the plurality of first contacts 13, that is, the portions on the −Y direction side of the held portions 13C are molded with respective contact portions 13A being exposed, and an insulator 22 surrounding the back portions of the held portions 13C of the plurality of first contacts 13, that is, the portions on the +Y direction side of the held portions 13C are molded with the respective connection portions 13B being exposed, to form the first module 26 in which the plurality of first contacts 13 are modularized.

Figure 13:
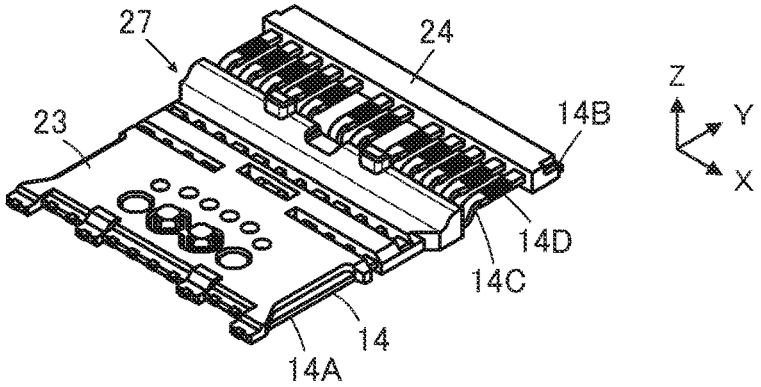
FIG. 13 is a perspective view showing a second module including the plurality of second contacts.

Similarly, as shown in FIG. 13, an insulator 23 surrounding the front portions of the held portions 14C of the plurality of second contacts 14, that is, the portions on the −Y direction side of the held portions 14C are molded with respective contact portions 14A being exposed, and an insulator 24 surrounding the back portions of the held portions 14C of the plurality of second contacts 14, that is, the portions on the +Y direction side of the held portions 14C are molded with the respective connection portions 14B being exposed, to form the second module 27 in which the plurality of second contacts 14 are modularized.

Figure 14:
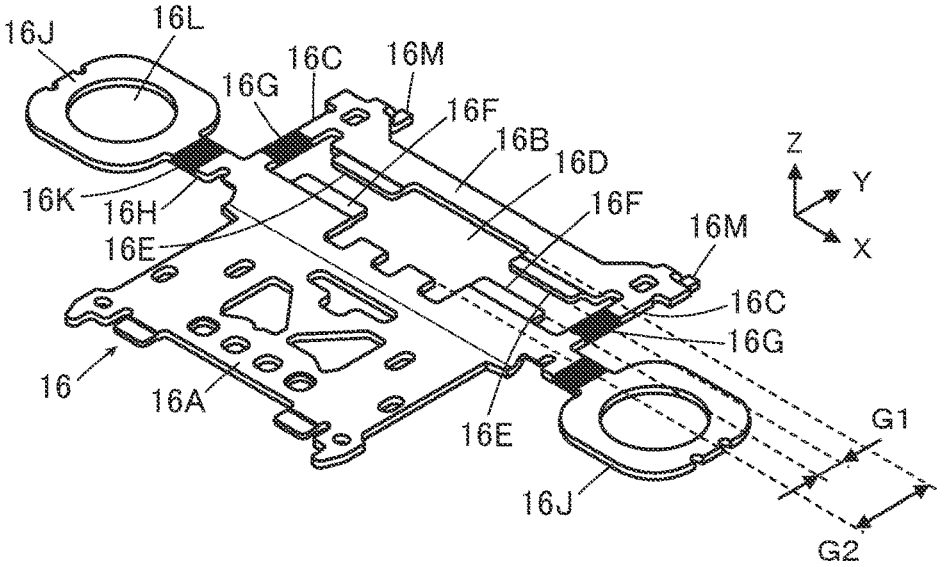
FIG. 14 is a perspective view showing a mid-plate used for the connector according to the embodiment.

As shown in FIG. 14, the mid-plate 16 clamped between the first module 26 and the second module 27 includes a front portion 16A in a flat plate-like shape, a rear portion 16B in a flat plate-like shape disposed apart from the front portion 16A in the +Y direction, and a pair of coupling portions 16C for coupling both end portions of the front portion 16A in the X direction and both end portions of the rear portion 16B in the X direction with each other.

Between the front portion 16A and the rear portion 16B, a gap 16D is formed. A pair of protrusions 16E protruding, inside the gap 16D, toward the front portion 16A in the −Y direction are formed at both end portions of the rear portion 16B in the X direction, respectively, and a pair of protrusions 16F protruding, inside the gap 16D, toward the rear portion 16B in the +Y direction are formed at both end portions of the front portion 16A in the X direction, respectively. Accordingly, the gap 16D is formed such that the lengths G1 in the Y direction at the vicinities of both end portions in the X direction are less than a length G2 in the Y direction at the center portion in the X direction.

The pair of coupling portions 16C each have a mid-plate-side waterproof shaped portion 16G. The mid-plate-side waterproof shaped portion 16G is embedded in the second insulator 20 to block entry of water along the interface with the second insulator 20, and includes at least one groove or projection formed on the surface of the coupling portion 16C to surround and enclose the coupling portions 16C. The mid-plate-side waterproof shaped portion 16G and the gap 16D are arranged at overlapping positions in the Y direction.

In addition, a protrusion 16J having a substantially rectangular flat plate shape is coupled to each of the end portions in the −Y direction of the pair of coupling portions 16C via an arm portion 16H extending outward in the X direction. The arm portion 16H has a mid-plate-side waterproof shaped portion 16K that is the same as the mid-plate-side waterproof shaped portion 16G of the coupling portion 16C. Further, an opening 16L is formed at the center of the protrusion 16J.

Furthermore, a mid-plate-side connection portion 16M, which is to be connected to a connection target object such as a substrate, is formed at each of both end portions of the rear portion 16B in the X direction.

Figure 15:
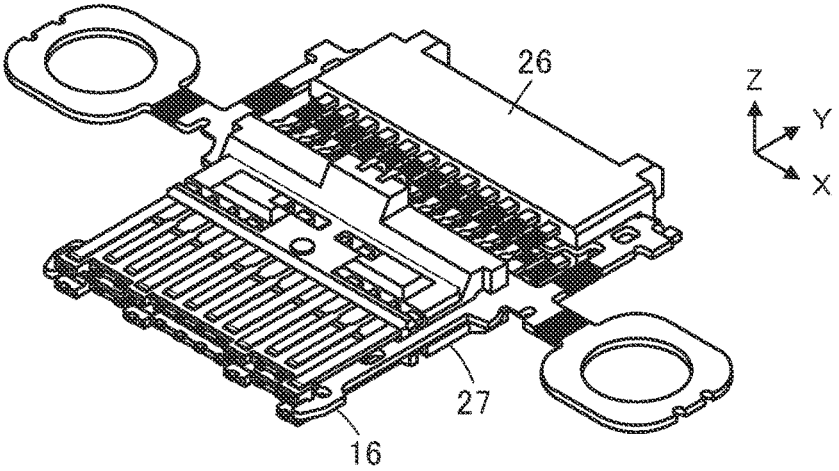
FIG. 15 is a perspective view showing that the mid-plate is clamped between the first module and the second module.

As shown in FIG. 15, the first module 26 is disposed on the +Z direction side of the mid-plate 16 and the second module 27 is disposed on the −Z direction side of the mid-plate 16 with the mid-plate 16 thus formed interposed in between. Although not shown, the front portion 16A of the mid-plate 16 faces the front portion on the −Y direction side relative to the contact-side waterproof shaped portions 13D of the plurality of first contacts 13 of the first module 26 and the front portion on the −Y direction side relative to the contact-side waterproof shaped portions 14D of the plurality of second contacts 14, while the rear portion 16B of the mid-plate 16 faces the back portion on the +Y direction side relative to the contact-side waterproof shaped portions 13D of the plurality of first contacts 13 of the first module 26 and the back portion on the +Y direction side relative to the contact-side waterproof shaped portions 14D of the plurality of second contacts 14. The contact-side waterproof shaped portions 13D of the plurality of first contacts 13 of the first module 26 and the contact-side waterproof shaped portions 14D of the plurality of second contacts 14 of the second module 27 are disposed at positions corresponding to the gap 16D of the mid-plate 16.

Figure 16:
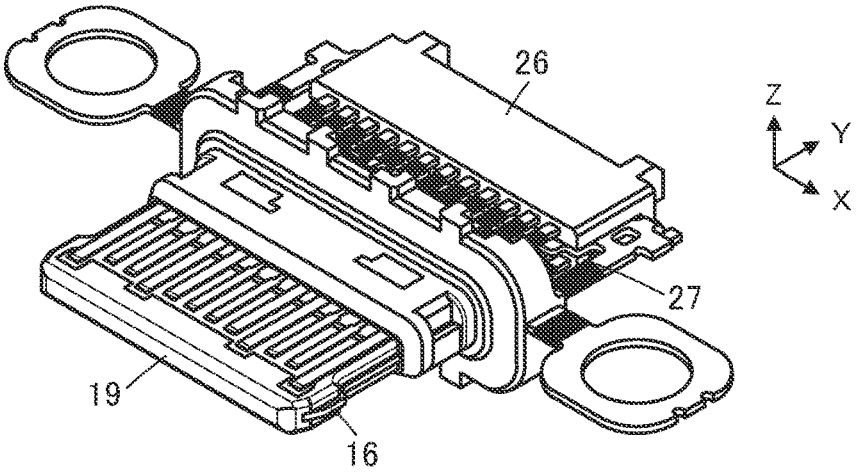
FIG. 16 is a perspective view showing that a first insulator is molded.

As shown in FIG. 16, the first insulator 19 is molded in a state where the mid-plate 16 is clamped between the first module 26 and the second module 27. The first insulator 19 is molded so as to integrate the mid-plate 16, the first module 26, and the second module 27 with one another.

Figure 17:
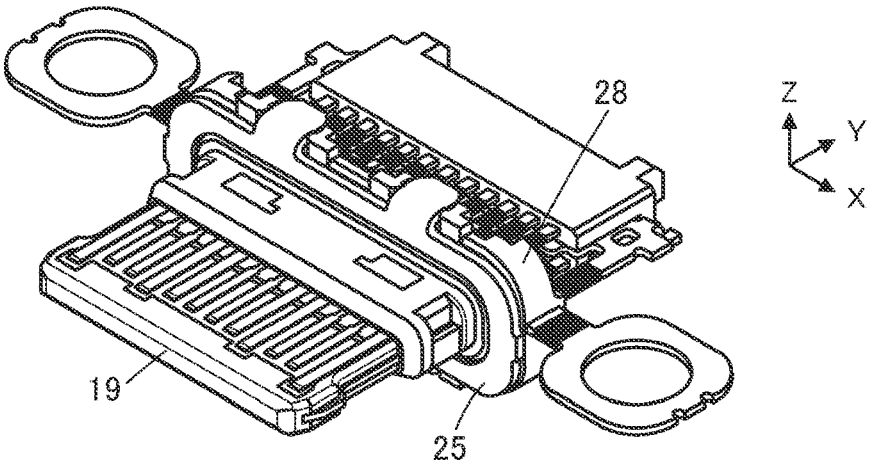
FIG. 17 is a perspective view showing that an inner plate is fitted into the first insulator.
Figure 18:
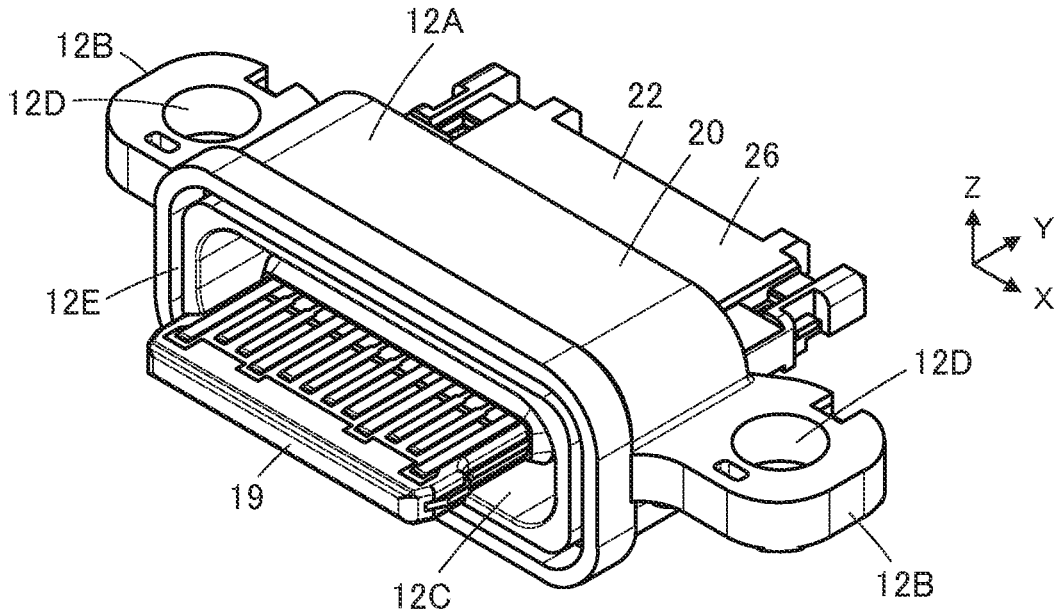
FIG. 18 is a perspective view showing that a second insulator is molded.

Further, as shown in FIG. 17, the inner plate 25 is fitted into the flange portion 28 of the first insulator 19 from the −Y direction side. Under this state, the second insulator 20 is molded as shown in FIG. 18. The second insulator 20 forms a tubular portion 12A including a mating connector receiving portion 12C therein and a pair of fixation portions 12B protruding from both end portions of the tubular portion 12A in the X direction.

Although not shown, the protrusion 16J of the mid-plate 16 is covered by the fixation portion 12B. The fixation portion 12B has a through hole 12D passing therethrough in the Z direction, and the opening 16L of the protrusion 16J of the mid-plate 16 corresponds to the through hole 12D of the fixation portion 12B.

In addition, a groove 12E encircling the end portion in the −Y direction of the mating connector receiving portion 12C is formed at the end portion in the −Y direction of the tubular portion 12A.

A metal shell 17 is disposed on the surface on the +Z direction side of the insulator 22 of the first module 26 protruding to the +Y direction side of the second insulator 20 to be exposed, and the waterproof member 18 is mounted into the groove 12E at the end portion in the −Y direction of the tubular portion 12A, to thus complete manufacturing of the connector 11 shown in FIGS. 1 to 3.

Note that, as shown in FIG. 2, at the end portion in the +Y direction of the connector 11, connection portions 13B of the plurality of first contacts 13, connection portions 14B of the plurality of second contacts 14, a pair of mid-plate-side connection portions 16M of the mid-plate 16, and the pair of leg portions 17A of the metal shell 17 is exposed and protrude in the −Z direction.

Figure 19:
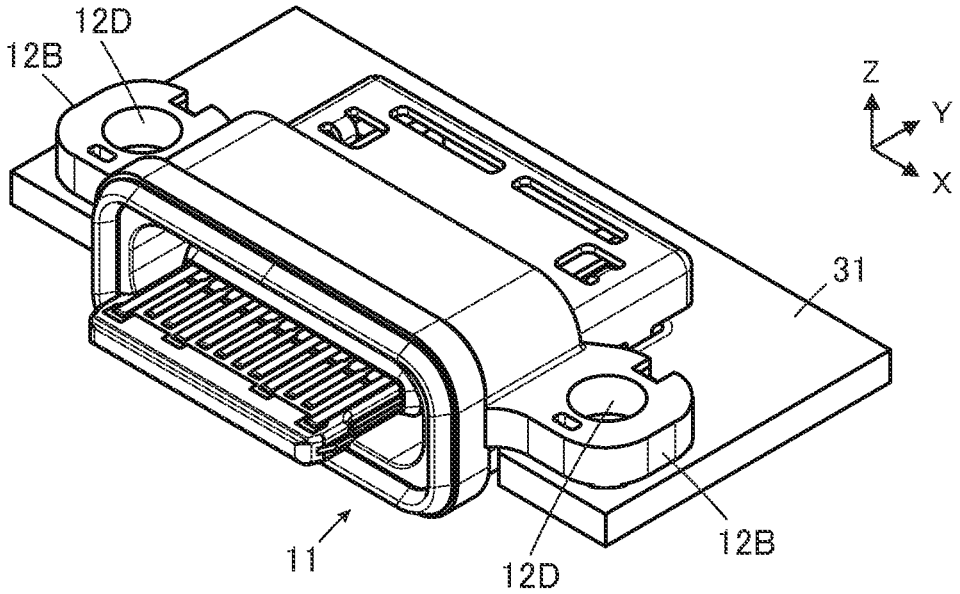
FIG. 19 is a perspective view showing the connector according to the embodiment mounted on a substrate.

FIG. 19 is a perspective view showing the connector 11 mounted on a substrate 31 being a connection target object. The connector 11 may be fixed to the substrate 31 by allowing fixing screws (not shown) to pass through the through holes 12D of the pair of fixation portions 12B.

The connection portions 13B of the plurality of first contacts 13 and the connection portions 14B of the plurality of second contacts 14, each protruding in the −Z direction from the end portion in the +Y direction of the connector 11, are each connected to connection pads (not shown) of the substrate 31. The pair of mid-plate-side connection portions 16M of the mid-plate 16 and the pair of leg portions 17A of the metal shell 17, each protruding in the −Z direction from the end portion in the +Y direction of the connector 11 are connected to a ground line (not shown) of the substrate 31, and the mid-plate 16 and the metal shell 17 are set at the ground potential.

Note that in a case where the second insulator 20 is molded such that the protrusion 16J of the mid-plate 16 is exposed to the −Z direction side of the fixation portion 12B, the connector 11 is fixed to the substrate 31 using fixing screws (not shown), whereby the protrusion 16J of the mid-plate 16 is connected to a ground pad (not shown) of the substrate 31, thus allowing the mid-plate 16 to be set at the ground potential as well.

Figure 20:
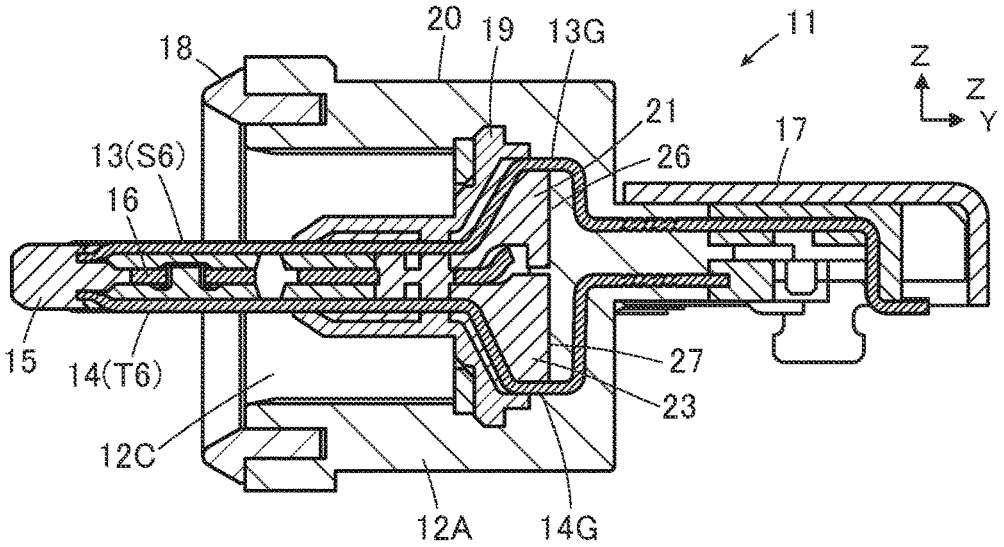
FIG. 20 is a cross-sectional view taken along the line B-B in FIG. 3.

FIG. 20 is a side cross-sectional view of the connector 11 cut along the YZ plane passing through the contacts S6 and T6 for low-speed signal transmission. The deformed portion 13G of the contact S6 bent toward the +Z direction in a manner separated from the mid-plate 16 is embedded in the insulator 21 of the first module 26 and the second insulator 20, while the deformed portion 14G of the contact T6 bent toward the −Z direction in a manner separated from the mid-plate 16 is embedded in the insulator 23 of the second module 27 and the second insulator 20.

Figure 21:
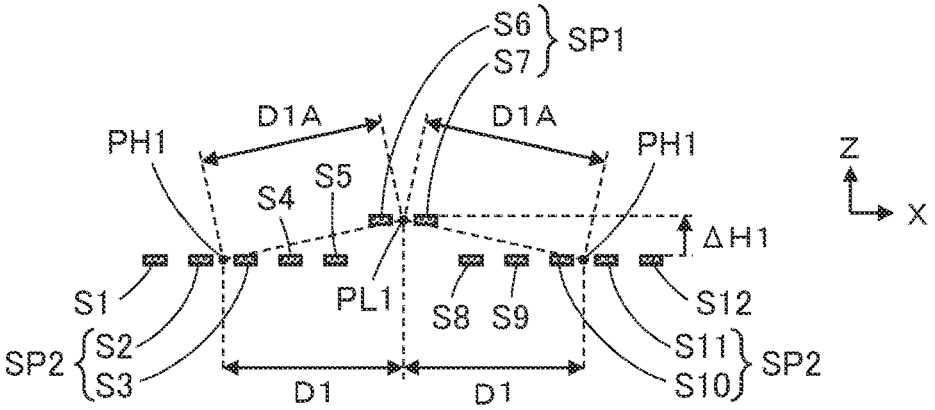
FIG. 21 is a sectional end face view of the plurality of first contacts by a plane passing through deformed portions of first contacts for low-speed signal transmission and being perpendicular to a fitting axis.

FIG. 21 shows a cut end face view of twelve contacts S1 to S12 constituting the plurality of first contacts 13, which is cut along the XZ plane passing through the deformed portion 13G of the contact S6 for low-speed signal transmission. As described with reference to FIG. 8, the deformed portion 13G of the contact S6 for low-speed signal transmission is located at the same position in the Y direction as the flat portion 13F of the contact S2 for high-speed signal transmission, and is formed higher than the flat portion 13F of the contact S2 by the height difference ΔH1 in the +Z direction. Another contact S7 for low-speed signal transmission has the same shape as the contact S6, and the other contacts S3, S10, and S11 for high-speed signal transmission have the same shape as the contact S2.

Accordingly, in the XZ plane passing through the deformed portion 13G of the contact S6 for low-speed signal transmission, the distance between a center point PL1 of the first pair SP1 constituted by the contacts S6 and S7 for low-speed signal transmission and a center point PH1 of the second pair SP2 constituted by the contacts S2 and S3 for high-speed signal transmission becomes a distance MA that is longer than the interval D1 between the center points PL1 and PH1 along the X direction. That is, supposing that the contacts S6 and S7 for low-speed signal transmission have the same shape as the contacts S2 and S3 for high-speed signal transmission without including the deformed portion 13G, the distance between the center point PL1 of the first pair SP1 and the center point PH1 of the second pair SP2 becomes an interval D1 along the X direction, while in the connector 11 according to the embodiment, the contacts S6 and S7 for low-speed signal transmission include the deformed portions 13G, thus the center point PL1 of the first pair SP1 is partially separated from the center point PH1 of the second pair SP2, whereby the distance between the center points PL1 and PH1 becomes the longer distance D1A.

Similarly, the distance between the center point PL1 of the first pair SP1 constituted by the contacts S6 and S7 for low-speed signal transmission and the center point PH1 of the second pair SP2 constituted by the contacts S10 and S11 for high-speed signal transmission becomes the distance DIA that is longer than the interval D1 between the center points PL1 and PH1 along the X direction as well.

This allows the noise generated at the contacts S6 and S7 of the first pair SP1 for low-speed signal transmission to impart less influence on the second pair SP2 of contacts S2 and S3 for high-speed signal transmission and the other second pair SP2 of contacts S10 and S11, thus reducing an occurrence of crosstalk. This makes it possible to perform a signal transmission with excellent characteristics.

Figure 22:
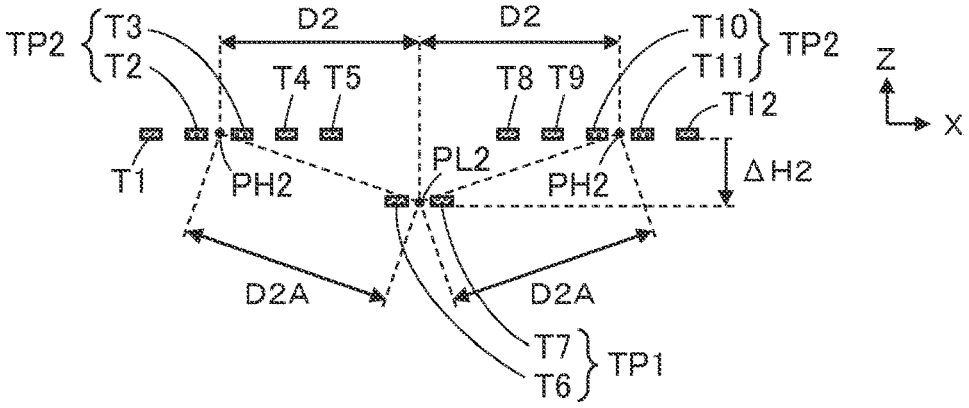
FIG. 22 is a sectional end face view of the plurality of second contacts by a plane passing through deformed portions of second contacts for low-speed signal transmission and being perpendicular to the fitting axis.
Figure 23:
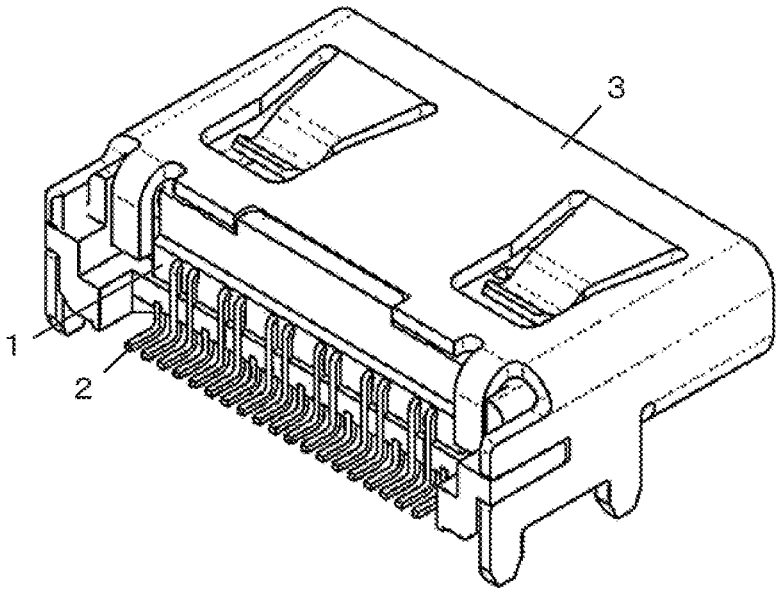
FIG. 23 PRIOR ART
FIG. 23 is a perspective view showing a conventional connector.
Figure 24:
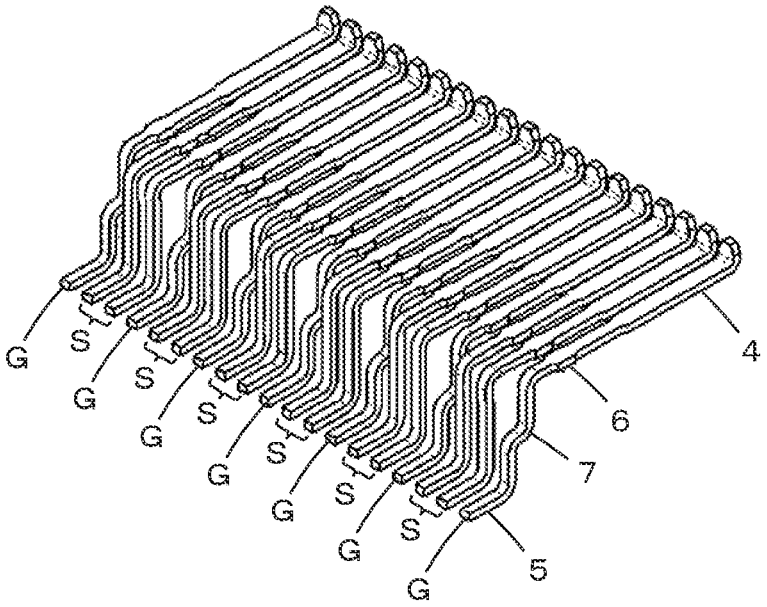
FIG. 24 PRIOR ART
FIG. 24 is a perspective view showing a plurality of contacts used for the conventional connector.

FIG. 22 shows a cut end face view of twelve contacts T1 to T12 constituting the plurality of second contacts 14, which is cut along the XZ plane passing through the deformed portion 14G of the contact T6 for low-speed signal transmission. As described with reference to FIG. 11, the deformed portion 14G of the contact T6 for low-speed signal transmission is located at the same position in the Y direction as the flat portion 14F of the contact T2 for high-speed signal transmission, and is formed lower than the flat portion 14F of the contact T2 by the height difference ΔH2 in the −Z direction. Another contact T7 for low-speed signal transmission has the same shape as the contact T6, and the other contacts T3, T10, and T11 for high-speed signal transmission have the same shape as the contact T2.

Accordingly, in the XZ plane passing through the deformed portion 14G of the contact T6 for low-speed signal transmission, the distance between a center point PL2 of the first pair TP1 constituted by the contacts T6 and T7 for low-speed signal transmission and a center point PH2 of the second pair TP2 constituted by the contacts T2 and T3 for high-speed signal transmission becomes a distance D2A that is longer than the interval D2 between the center points PL2 and PH2 along the X direction. That is, supposing that the contacts T6 and T7 for low-speed signal transmission have the same shape as the contacts T2 and T3 for high-speed signal transmission without including the deformed portion 14G, the distance between the center point PL2 of the first pair TP1 and the center point PH2 of the second pair TP2 becomes an interval D2 along the X direction, while in the connector 11 according to the embodiment, the contacts T6 and T7 for low-speed signal transmission include the deformed portions 14G, thus the center point PL2 of the first pair TP1 is partially separated from the center point PH2 of the second pair TP2, whereby the distance between the center points PL2 and PH2 becomes the longer distance D2A.

Similarly, the distance between the center point PL2 of the first pair TP1 constituted by the contacts T6 and T7 for low-speed signal transmission and the center point PH2 of the second pair TP2 constituted by the contacts T10 and T11 for high-speed signal transmission becomes the distance D2A that is longer than the interval D2 between the center points PL2 and PH2 along the X direction as well.

This allows the noise generated at the contacts T6 and T7 of the first pair TP1 for low-speed signal transmission to impart less influence on the second pair TP2 of contacts T2 and T3 for high-speed signal transmission and the other second pair TP2 of contacts T10 and T11, thus reducing an occurrence of crosstalk. This makes it possible to perform a signal transmission with excellent characteristics.

Note that, as shown in FIG. 14, the pair of protrusions 16E are formed at both end portions of the rear portion 16B of the mid-plate 16 in the X direction, and the pair of protrusions 16F are formed at both end portions in the X direction of the front portion 16A, where these protrusions 16E and 16F face two second pairs SP2 of contacts S2 and S3 and the contacts S10 and S11 for high-speed signal transmission included in the plurality of first contacts 13, and face two second pairs TP2 of contacts T2 and T3 and contacts T10 and T11 for high-speed signal transmission included in the plurality of second contacts 14. However, the protrusions 16E and 16F do not face the first pair SP1 of contacts S6 and S7 for low-speed signal transmission included in the plurality of first contacts 13 and the first pair TP1 of contacts T6 and T7 for low-speed signal transmission included in the plurality of second contacts 14.

That is, the gap 16D of the mid-plate 16 facing the first pairs SP1 and TP1 for low-speed signal transmission have no protrusions 16E and 16F and have a length G2 along the Y direction, while the gap 16D of the mid-plate 16 facing the second pairs SP2 and TP2 for high-speed signal transmission have the length G1 that is less than the length G2 by the protrusions 16E and 16F along the Y direction.

In this way, the mid-plate 16 faces the second pairs SP2 and TP2 for high-speed signal transmission over a range in the Y direction being longer than the first pairs SP1 and TP1 for low-speed signal transmission, and even if high-speed signals are passed through the contacts S2, S3, S10, and S11 constituting the two second pairs SP2 and the contacts T2, T3, T10, and T11 constituting the two second pairs of TP2 for high-speed signal transmission, crosstalk is minimized to allow a transmission of high reliance to be performed.

Note that, although the connection portions 13B of the plurality of first contacts 13 and the connection portions 14B of the plurality of second contacts 14 are exposed at the end portion in the +Y direction of the connector 11, the contact-side waterproof shaped portions 13D are formed on the plurality of first contacts 13 and the contact-side waterproof shaped portions 14D are formed on the plurality of second contacts 14, whereby the contact-side waterproof shaped portions 13D and 14D are embedded in the second insulator 20, thus blocking an entry of water along the interface between the first and second contacts 13 and 14 and the second insulator 20.

In addition, the contact-side waterproof shaped portions 13D of the plurality of first contacts 13 and the contact-side waterproof shaped portions 14D of the plurality of second contacts 14 are disposed at positions corresponding to the gap 16D of the mid-plate 16, thus ensuring a resin of sufficient thickness composing the second insulator 20 around the contact-side waterproof shaped portions 13D and 14D without having an influence from the mid-plate 16 and without increasing the height of the connector 11 in the Z direction. This provides high contractive force of resin when molding the second insulator 20 to achieve excellent waterproofness.

In particular, the contact-side waterproof shaped portions 13D and 14D includes at least one groove or projection formed on the surfaces of the first contact 13 and the second contact 14 to surround and enclose the first contact 13 and the second contact 14 respectively, to thus efficiently block entry of water along the interface with the second insulator 20.

Note that, although the mid-plate-side connection portion 16M of the mid-plate 16 is exposed from the end portion in the +Y direction of the connector 11, the mid-plate-side waterproof shaped portion 16G of the coupling portion 16C is embedded in the second insulator 20, to thus block entry of water along the interface between the coupling portion 16C and the second insulator 20.

Similarly, the pair of arm portions 16H of the mid-plate 16 each have the mid-plate-side waterproof shaped portion 16K as well, thus, even if at least a part of the protrusion 16J is exposed from the fixation portion 12B of the second insulator 20, the mid-plate-side waterproof shaped portion 16K is embedded in the second insulator 20, thus blocking entry of water along the interface between the arm portion 16H and the second insulator 20.

Accordingly, water is prevented from entering the substrate 31 side through the interior of the mating connector receiving portion 12C of the second insulator 20.

In the above-described embodiments, the plurality of first contacts 13 include the contact-side waterproof shaped portions 13D of the contacts S6 and S7 for low-speed signal transmission at positions different from the deformed portions 13G. However, the contact-side waterproof shaped portion 13D and the deformed portion 13G may also be formed in the held portion 13C to be embedded in the housing 12, to thus allow the contact-side waterproof shaped portion 13D to be formed in the deformed portion 13G.

Similarly, the plurality of second contacts 14 include the contact-side waterproof shaped portions 14D of the contacts T6 and T7 for low-speed signal transmission at positions different from the deformed portion 14G. However, the contact-side waterproof shaped portion 14D and the deformed portion 14G may also be formed in the held portion 14C to be embedded in the housing 12, to thus allow the contact-side waterproof shaped portion 14D to be formed in the deformed portion 14G.

Further, among the plurality of first contacts 13 in the above-described embodiments, the first pair SP1 of contacts S6 and S7 for low-speed signal transmission include the deformed portions 13G, while the two second pairs SP2 of contacts S2, S3, S10, and S11 for high-speed signal transmission do not include the deformed portions 13G. Conversely, a configuration in which the two second pairs SP2 of contacts S2, S3, S10, and S11 for high-speed signal transmission include the deformed portions 13G and the first pair SP1 of contacts S6 and S7 for low-speed signal transmission do not include the deformed portions 13G can also reduce crosstalk between the first pair SP1 and the second pairs SP2.

Similarly, among the plurality of second contacts 14, the first pair TP1 of contacts T6 and T7 for low-speed signal transmission include the deformed portions 14G, while the two second pairs TP2 of contacts T2, T3, T10, and T11 for high-speed signal transmission do not include the deformed portions 14G. Conversely, a configuration in which the two second pairs TP2 of contacts T2, T3, T10, and T11 for high-speed signal transmission include the deformed portions 14G and the first pair TP1 of contacts T6 and T7 for low-speed signal transmission do not include the deformed portions 14G can also reduce crosstalk between the first pair TP1 and the second pairs TP2.

However, since the impedance of each contact for high-speed signal transmission may vary due to the formation of the deformed portions 13G and 14G, the deformed portions 13G and 14G may preferably be formed in each contact for low-speed signal transmission.

In the above-described embodiments, each deformed portion 13G of the first pair SP1 of contacts S6 and S7 is embedded in the insulator 21 of the first module 26 and the second insulator 20, while each deformed portion 14G of the first pair TP1 of contacts T6 and T7 is embedded in the insulator 23 of the second module 27 and the second insulator 20. In this way, each deformed portion of the first pair of contacts may be embedded across a plurality of separated insulators, or may be embedded in one continuous insulator.

Similarly, also in a case that the second pair of contacts includes the deformed portions, each deformed portion of the second pair of contacts may be embedded across a plurality of separated insulators, or may be embedded in one continuous insulator.

In the above-described embodiments, although the plurality of first contacts 13 and the plurality of second contacts 14 are aligned in two rows so as to face both surfaces of the mid-plate 16 respectively, the invention is not limited thereto and may also be applied to a connector in which a plurality of contacts are aligned in a single row.

In addition, the number of contacts is not limited as long as it suffices to include the first pair of contacts and the second pair of contacts.

Note that in a case where the invention is applied to a connector that doesn't require waterproof function, the contact-side waterproof shaped portions 13D of the plurality of first contacts 13, the contact-side waterproof shaped portions 14D of the plurality of second contacts 14, the mid-plate-side waterproof shaped portions 16G and 16K of the mid-plate 16, and the waterproof member 18 are not required to be disposed in the connector.

What is claimed is:

1. A connector comprising:

a plurality of contacts each extending in a fitting direction, the plurality of contacts including a first pair of contacts and a second pair of contacts; and a housing configured to hold the plurality of contacts, wherein the plurality of contacts each include a contact portion disposed at a front end in the fitting direction and to be in contact with a contact of a mating connector, a connection portion disposed at a back end in the fitting direction and to be connected to a connection target object, and a held portion disposed between the contact portion and the connection portion and embedded in the housing, wherein the plurality of contacts have at least one contact row aligned in an alignment direction orthogonal to the fitting direction, and wherein the first pair of contacts each include, in the held portion, a deformed portion partially separated from the second pair of contacts arranged in a same contact row as the first pair of contacts.

2. The connector according to claim 1, wherein the deformed portion is formed such that the first pair of contacts is bent in a direction orthogonal to both the fitting direction and the alignment direction.

3. The connector according to claim 1, wherein the first pair of contacts are contacts for low-speed signal transmission and the second pair of contacts are contacts for high-speed signal transmission.

4. The connector according to claim 1, further comprising a mid-plate that is made of metal and disposed to face the plurality of contacts, wherein the plurality of contacts includes a first row of contacts and a second row of contacts that are aligned to face both surfaces of the mid-plate respectively with the mid-plate interposed therebetween.

5. The connector according to claim 4, wherein each of the first row of contacts and the second row of contacts includes the first pair of contacts and the second pair of contacts.

6. The connector according to claim 5, wherein the deformed portions of the first pair of contacts of the first row of contacts and the deformed portions of the first pair of contacts of the second row of contacts each bend so as to be separated from the mid-plate.

7. The connector according to claim 4, wherein the mid-plate includes:

a front portion in a flat plate-like shape and a rear portion in a flat plate-like shape each facing the plurality of contacts; and a coupling portion that couples the front portion and the rear portion with each other such that a gap is formed between the front portion and the rear portion, the coupling portion including a mid-plate-side waterproof shaped portion embedded in the housing to block entry of water along an interface with the housing.

8. The connector according to claim 7, wherein the mid-plate-side waterproof shaped portion includes at least one groove or projection formed on a surface of the coupling portion so as to surround and enclose the coupling portion.

9. The connector according to claim 7, wherein the plurality of contacts each include a contact-side waterproof shaped portion formed in the held portion and embedded in the housing to block entry of water along an interface with the housing.

10. The connector according to claim 9, wherein the contact-side waterproof shaped portion includes at least one groove or projection formed on a surface of the contact so as to surround and enclose the contact.

11. The connector according to claim 9, wherein the contact-side waterproof shaped portion of each of the plurality of contacts is disposed, in the fitting direction, at a position corresponding to the gap of the mid-plate.

12. The connector according to claim 7, wherein the housing includes a mating connector receiving portion opening forward in the fitting direction, and wherein the contact portions of the plurality of contacts are exposed at least in the mating connector receiving portion.

13. The connector according to claim 12, wherein the housing includes:

a first insulator covering front portions of the held portions of the plurality of contacts and the front portion of the mid-plate so as to expose the contact portions of the plurality of contacts; and a second insulator covering back portions of the held portions of the plurality of contacts, the coupling portion and the rear portion of the mid-plate, and a back portion of the first insulator so as to expose the connection portions of the plurality of contacts, and wherein the second insulator forms the mating connector receiving portion, and the first insulator seals a bottom portion of the mating connector receiving portion.

14. The connector according to claim 12, further comprising a metal shell attached to a back portion of the housing and covering the connection portions of the plurality of contacts.

15. The connector according to claim 12, further comprising a seamless waterproof member surrounding a front end portion of the mating connector receiving portion disposed at a front end portion in the fitting direction of the housing.

16. The connector according to claim 12, further comprising an inner plate disposed at a bottom portion of the mating connector receiving portion and to be abutted by the mating connector received in the mating connector receiving portion when fitted to the mating connector.

17. The connector according to claim 1, wherein the housing includes a pair of fixation portions protruding to both sides of the plurality of contacts in the alignment direction, the housing being fixed to the connection target object via the pair of fixation portions.

18. The connector according to claim 17, wherein the mid-plate includes a pair of protrusions protruding to both sides of the plurality of contacts in the alignment direction and being covered with the pair of fixation portions of the housing.

* * * * *